United States Patent [19]

Peters

[11] 3,985,559

[45] Oct. 12, 1976

[54] TONER POWDER FOR ELECTROSTATIC IMAGES

[75] Inventor: Martinus T. J. Peters, Venlo, Netherlands

[73] Assignee: Oce-van der Grinten N.V., Venlo, Netherlands

[22] Filed: Oct. 16, 1974

[21] Appl. No.: 515,318

[30] Foreign Application Priority Data

Oct. 23, 1973 Belgium ..... 136973

[52] U.S. Cl. ..... 96/1 SD; 252/62.1 P; 427/14

[51] Int. Cl.[2] ..... G03G 9/08

[58] Field of Search ..... 252/62.1 P; 96/1 SP; 427/14

[56] References Cited

UNITED STATES PATENTS

| | | | |
|---|---|---|---|
| 3,236,639 | 2/1966 | Tomanek | 252/62.1 P |
| 3,647,696 | 3/1972 | Olson | 252/62.1 P |

*Primary Examiner*—Edward G. Whitby
*Attorney, Agent, or Firm*—Albert C. Johnston

[57] ABSTRACT

Toner powders for developing electrostatic images are provided with improved control of the polarity and the color of the particles by forming them of thermoplastic resin containing in dissolved state therein a normal salt of an organic basic dye, e.g. a Safranine dye, and an organic acid, e.g. a phenoxy acetic acid, having at least 6 carbon atoms and having a dissociation constant less then 4 as measured in water at 25°C.

7 Claims, No Drawings

TONER POWDER FOR ELECTROSTATIC IMAGES

This invention relates to a toner powder for the development of electrostatic images.

In the electrographic imaging techniques an electrostatic image is formed on an insulating surface, as by means of a cathode ray tube or by writing with a charged pin, or on a photoconductive surface by charging it electrostatically in the dark and then exposing it imagewise. The electrostatic image is subsequently developed by applying to it colored particles, called toner particles, which have an electrostatic charge of a polarity opposite to that of the image. Both liquid developers and powder developers are used.

The powder developers generally used in present practice consist of a mixture of very fine toner particles having sizes predominantly not larger than 40 microns and relatively coarse carrier particles having sizes between about 40 and a few hundreds of microns. The toner particles adhere to the carrier particles as a result of triboelectric charging. The compositions of the toner and carrier particles are selected so that the toner particles, upon triboelectric contact with the carrier particles, accept a charge of which the polarity is opposite to that of the electrostatic image to be developed.

The toner particles most commonly used in powder developers are colored themoplastic resin particles that contain a compound, called a polarity control agent, which causes the toner particles to accept an electrostatic charge of the required polarity upon triboelectric contact with the carrier particles. The polarity control agent usually is an organic dye, so that it can also be a coloring component of the toner particles. The toner particles may also contain a pigment, usually carbon black, as a coloring component. The toner particles are usually prepared by melting the thermoplastic resin, dispersing the polarity control agent and the coloring pigment in the melted resin, cooling the melt to a solid mass and finally milling the solid mass into particles of the size desired.

Various methods are known for applying the powder developer to the electrostatic image. The best known methods are the magnetic brush method, in which the powder developer used contains magnetically attractable carrier particles, usually iron particles, and the cascade method in which the powder developer used commonly contains glass granules as carrier particles.

With the magnetic brush method the powder developer is transported to the electrostatic image by a magnetic transport means, for instance a roller having a magnetic core and a sleeve of diamagnetic material. The magnetically attractable carrier particles are held to the transport means by magnetic forces and thus form a brush to which the toner particles adhere electrostatically. When the brush comes into contact with the electrostatic image, the toner particles are pulled out of the brush by image charges and are deposited on the image.

With the cascade method a quantity of powder developer from a stock of powder is strewn over the image to be developed. The strewn developer powder flows over the surface carrying the image, whereby toner particles are deposited on the electrostatic image, and returns again to the stock of powder or to a separate receiving tray from where it may again be fed back to the original stock of powder.

For obtaining good developing results, that is images of sufficient optical density on a toner-free or almost toner-free background, it is important that all toner particles in the developer powder have a charge of the required polarity. This condition can be fulfilled if the polarity control agent is present homogeneously at the surface of the toner particles. A homogeneous distribution of the polarity control agent over the surface of the toner particles is evidently obtained when a compound used as polarity control agent fully dissolves in the thermoplastic resin component of the toner.

In usual practice only organic dyes, especially basic dyes, are used as the polarity control agent in toner powders. Some examples of well-known polarity control agents are Nigrosine, Induline, Methylene Blue, Crystal Violet, Methyl Violet and Victoria Blue. The basic dyes are usually used in powder toners in the form of their chlorides, but sometimes also as a free dye base.

Many dyes used as polarity control agent have the objection that they are insoluble in the thermoplastic resins of which the powder toners are usually prepared, for instance polystyrene, styrene copolymers, polyamides and modified or unmodified phenol-formaldehyde and maleinate resins. Moreover, many dyes cannot be distributed readily in the thermoplastic resin, so that often a long and intensive mixing of the dye with the melted resin is required in order to obtain an acceptable distribution.

German Pat. No. 1 929 851 proposes, in order to improve the solubility of nigrosine in thermoplastic resin, to convert the nigrosine into the salt with an organic carboxylic acid, such as lauric acid, azelaic acid, sebacic acid, adipic acid, abietic acid, stearic acid, or chloroacetic acid. Especially nigrosine stearate is used. Since nigrosine does not have a constant chemical composition, the salts prepared from variously produced nigrosine consequently are also of different composition. Although the carboxylic nigrosine salts of various qualities are better soluble in many thermoplastic resins than are nigrosine base and nigrosine chloride, they have not appeared to be always soluble in the concentration desired in all the resins used for the manufacture of toner. It has appeared, for instance, that many salts prepared according to the said German patent are insoluble in styrene copolymers, such as copolymers of styrene with indene and of styrene with indene and acrylonitrile, which copolymers are very beneficial for the preparation of powder toners. When salts are prepared of acids above mentioned with basic dyes other than nigrosine, for instance, the salts described in French Pat. application No. 2 010 820, it is possible to obtain polarity control agents of constant composition that are soluble in thermoplastic resin. However, these soluble salts appear to lose their charge-regulating effect and their coloring capacity when they are processed in the resin melt for some time at the usual temperatures of 90°– 130 ° C. During the preparation of the toner powders the mixing of the salt with the melted resin must therefore be made in a time so short that it is often difficult to achieve the desired homogeneous distribution of the polarity control agent throughout the mass of resin.

The present invention provides improved powder toners for the development of electrostatic images, which contain in the thermoplastic resin of the powder particles a polarity control agent that obviates or greatly alleviates the disadvantages of the above mentioned salts of basic dyes.

It has been found that highly effective control of the polarity of the toner particles and other advantages are attained by the provision of powder toners consisting of particles of thermoplastic resin having dissolved therein a normal salt of a basic dye with an organic acid having at least 6 carbon atoms and having a dissociation constant lower than 4 as measured in water at 25° C. By a normal salt is meant a salt that contains equivalent quantities of basic dye and organic acid in its molecule.

The basic dye salts used according to the invention constitute polarity control agents which are soluble in most of the thermoplastic resins used for toner preparation, and which do not lose their charge-regulating effect or their coloring capacity when they are processed in a resin melt for a prolonged time, for instance a few hours, at temperatures up to about 140° C.

The dye component of the salt present in the toner particles according to the invention is a basic dye belonging to one of the following groups: azo dyes, xanthene dyes, acridine dyes, methine dyes, azine dyes, oxazine dyes, thiazine dyes, di- and triphenylmethane dyes, quinoline dyes, indamine dyes and indophenol dyes. Preferably the basic dye is selected from the group formed by di- and triphenylmethane dyes, azine dyes, oxazine dyes, thiazine dyes, xanthene dyes, mono-azo dyes and acridine dyes.

Basic Safranine dyes, which belong to the azine class, are especially beneficial because they form salts of very high heat-stability with the defined organic acids, particularly with the phenoxy acetic acids hereinafter specified.

The dye is used in the toner particles according to the invention in the form of a normal salt of the dye and an organic acid having at least 6 carbon atoms and a dissociation constant lower than 4. It has not appeared that a critical upper limit exists for the number of carbon atoms in the organic acid, but in general an acid is chosen which contains between 6 and 30 carbon atoms.

Among the organic acids suitable for making the basic dye salts used according to the invention, monobasic sulfonic- and carboxylic acids are preferred. Suitable acids are: alkyl- and alkylaryl monoesters of sulfuric acid, such as octyl hydrogensulfate, decyl hydrogensulfate, dodecyl hydrogensulfate, hexylphenyl hydrogensulfate, dodecylphenyl hydrogensulfate, dibutylphenyl hydrogensulfate; aryl-sulfonic acids of which the aryl residue carries one or more alkyl or alkoxy groups, such as dodecylbenzene sulfonic acid, tridecylbenzene sulfonic acid, dibutylnaphthalene sulfonic acid, nonylnaphthalene sulfonic acid; aliphatic monocarboxylic acids of which the α-carbon atom carries one or more electron attracting groups, such as α-bromocaproic acid, α-chloro-stearic acid, α-bromostearic acid, α-cyano-stearic acid and cyclohexylcyano acetic acid.

Other suitable acids are sulfonic and carboxylic acids, having in total at least 6 carbon atoms, which meet one of the general formulae I or II:

I $ROOC-\underset{\underset{SO_3H}{|}}{CH}-CH_2-COOR_1$ II $X-\underset{\underset{R_2}{|}}{CH}-COOH$ in which R and $R_1$ represent alkyl groups having at least 4 carbon atoms, $R_2$ is a hydrogen atom or an alkyl group and X stands for an alkoxy or cycloalkoxy group having at least 4 carbon atoms, an aryloxy group, or a group $$-N\begin{matrix}R_3\\R_4\end{matrix}$$

in which $R_3$ represents a hydrogen atom or an alkyl or aryl group and $R_4$ is a hydrogen atom or an alkyl group.

Examples of such acids are: di-isobutylsufosuccinic acid, dihexylsulfosuccinic acid, dioctylsulfosuccinic acid, cyclopentoxy acetic acid, cyclohexyloxy acetic acid, cyclohexyl methoxy acetic acid, 3-methylcyclohexyloxy acetic acid, α-cyclohexyloxypropionic acid, α-(3-methylcyclohexyloxy)-butyric acid, phenoxy acetic acid, phenylglycine and 2-amino-caprylic acid.

Very attractice acids for making the dye salts used according to the invention are the above-mentioned dialkylesters of sulfosuccinic acid and monoesters of sulfuric acid and, further, especially the acids according to the above formula II in which X represents a group

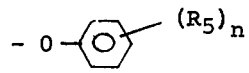

wherein $R_5$ is an alkyl or alkoxy group and *n* is equal to 1 to 2 . Examples of attractive acids of the last mentioned group are: 2-methylphenoxy acetic acid, 3-methylphenoxy acetic acid, 2,4-dimethylphenoxy acetic acid, 4-methyl-2-tert.butylphenoxy acetic acid, 2,4-ditert.pentylphenoxy acetic acid, 2-(2,4-ditert.pentyl)-phenoxy butyric acid, 2-methoxyphenoxy acetic acid and 4-ethoxyphenoxy acetic acid.

Many of the acids preferably used are commercially available. Their normal salts with basic dyes of the dye groups specified above can easily be prepared from equivalent quantities of acid and dye. These salts possess good solubility in thermoplastic resins, and they are very good polarity control agents which, moreover, have a high coloring capacity and do not lose either their polarity controlling effect or their high coloring capacity upon long mixing in a warm resin melt. Among these salts, those made from safranine dyes are outstanding for their high heat-stability. Consequently these salts of the basic dyes are suitable not only for the preparation of opaque, pigmented toner powders, but also for the preparation of transparent, colored toner powders which can be used in electrostatic multicolor reproduction processes.

The salts of the basic dyes for use according to the invention can be prepared in a known way by reacting the dye base or its salt with an inorganic acid, for instance its chloride, in a suitable solvent, for instance an alcohol, an alcohol-water mixture, a liquid hydrocarbon such as benzene or toluene, or a halogenated hydrocarbon such as chloroform, at raised or at normal temperature, with an equivalent quantity of organic acid or a salt of it, and subsequently separating the normal salt of the basic dye from the reaction mixture.

The quantity of the basic dye salt used in the toners according to the invention generally amounts to less than 10 per cent by weight and preferably to less than 5 per cent by weight.

The thermoplastic resin from which the toner particles are prepared can be selected from among resins known to be useful for the preparation of powder toners, such as polystyrene, copolymers of styrene with acrylates or methacrylates, especially butyl methacrylate, polyamides, polyester resins, pheno-formaldehyde resins, whether or not modified with colophony, epoxy resins, polyethylene, polyvinyl chloride, alkyd resins modified with colophony, and mixtures of such resins.

Preferably the thermoplastic resin is a styrene copolymer, such as a copolymer of styrene with an acrylate or methacrylate, especially butyl methacrylate, or a copolymer of styrene with indene or with indene and acylonitrile, which copolymer contains 70–97 per cent by weight of styrene, 3–20 per cent by weight of indene and 0–15 per cent by weight of acrylonitrile.

Besides the thermoplastic resin and the salt of the basic dye the toner particles according to the invention may contain the usual additions, for instance a pigment such as carbon black, zinc oxide, titanium dioxide, red lead or chrome yellow.

For obtaining a developing powder the toner particles are mixed as known with carrier particles which may, for instance, be composed of iron, a metal oxide or glass. If the developing powder is destined to be applied by the magnetic brush method, magnetically attractable carrier particles, for instance iron particles, are used. The developing powder preferably contains 97–93 per cent by weight of carrier particles and 3–7 per cent by weight of toner particles.

EXAMPLE 1

A. 576 g of terpolymer of styrene, indene and acrylonitrile (Piccoflex 120 of Pennsylvania Chemical Corp., U.S.A.) and 6 g of Crystal Violet stearate were mixed in a Wink Worth 2-Blade Mixer for 60 minutes at a temperature of 90°–100° C, whereby the salt of the basic dye fully dissolved in the resin melt. Subsequently 18 g of carbon were added to the mixture, whereupon the mixing was continued for 180 minutes at 90°–100° C.

The warm melt, in which the blue color of the Crystal Violet stearate had almost fully disappeared, was subsequently removed from the mixing apparatus and was cooled down to a solid mass. The solid mass was milled into fine particles having sizes between 8 and 30 microns.

50 g of the toner powder thus obtained and 950 g of iron powder were mixed for 10 minutes in a paint shaking apparatus. The polarity of the toner particles of the powder developer thus obtained was determined. It thus appeared that 70 per cent by weight of the toner particles had a positive charge and 30 per cent by weight had a negative charge. The powder developer was used for magnetic brush development of a negative electrostatic image present in a photoconductive ZnO-binder layer. The copies obtained were of bad quality which showed a strong deposition of toner in the background areas.

B. A powder developer was prepared in the same way as described in part A above, except that instead of 6 g of Crystal Violet stearate 6 g of Crystal Violet-2,4-ditert. pentylphenoxy acetate was used. The salt dissolved completely in the melted resin, without losing its blue color.

Upon determining the polarity of the toner particles in the powder developer obtained, all the toner particles appeared to have a positive charge. The powder developer yielded copies of good quality upon being used in magnetic brush development of electrostatic images formed in a ZnO-binder layer.

In a third test, instead of 6 g of Crystal Violet stearate 6 g of nigrosine stearate was used for preparing the toner powder. The nigrosine salt was prepared from Nigrosinebase 3B (of Bayer A.G., Germany) according to the process of example 1 of German Pat. No. 1 929 851. The nigrosine stearate appeared to dissolve only partially in the resin melt.

EXAMPLE 2

336 g of terpolymer of styrene, indene and acrylonitrile (Piccoflex 120) and 3.5 g of the salt of Crystal Violet with 2-(2,4-ditert-.pentylphenoxy) butyric acid were mixed in a Wink Worth 2-Blade Mixer for 30 minutes at a temperature of 90°–100° C, after which 10.5 g of carbon were added to the warm melt, whereupon the mixing was continued for 30 minutes. The salt of the basic dye dissolved fully in the resin melt, while retaining its coloring capacity. The warm melt was cooled down to a solid mass, which subsequently was milled into particles having sizes between 8 and 30 microns.

50 g of the toner powder thus obtained and 950 g of iron powder were mixed for 10 minutes in a shaking apparatus, after which the polarity of the toner particles was determined. It appeared that all the toner particles had a positive charge. The powder developer was applied in an electrophotographic copying device as described in Dutch Pat. application No. 72 05 491. Copies of very good quality were obtained.

EXAMPLES 3–29

Table I below gives the compositions of a large number of toner powders according to the invention, while also indicating the carrier particles with which the toner particles were mixed and the charging polarity of the toner particles upon being mixed with the carrier particles. The powder developers each contained 5 per cent by weight of toner particles and 95 per cent by weight of carrier particles.

The toner particles were prepared by first mixing the salt of the basic dye at a temperature between 90° and 130° C with the melted resin and, after the dye had fully dissolved in the resin, adding, if wanted, carbon to the melt and continuing the mixing until the carbon had homogeneously dispersed in the melt. The total mixing time was 1.5–2 hours. The warm melt was subsequently cooled down to a solid mass and the solid mass was milled into particles having sizes between 5 and 30 microns.

TABLE I

| Powder No. | Basic Dye Salt | Dye Salt % wt. | Carbon Black % wt. | Resin | Carrier Particles | Toner Polarity |
|---|---|---|---|---|---|---|
| 1 | — | — | 3 | Styrene-indene-acrylonitrile terpolymer | Iron | Neg. |

TABLE I-continued

| Powder No. | Basic Dye Salt | Dye Salt % wt. | Carbon Black % wt. | Resin | Carrier Particles | Toner Polarity |
|---|---|---|---|---|---|---|
| 2 | Crystal Violet-dioctyl-sulfosuccinic acid | 2.5 | 3.5 | " | " | Pos. |
| 3 | " | 0.25 | 3 | " | " | Pos. |
| 4 | Crystal Violet-dipentyl-sulfosuccinic acid | 1 | 2 | " | " | Pos. |
| 5 | Crystal Violet dodecyl-hydrogensulfate | 1 | 2 | " | " | Pos. |
| 6 | Crystal Violet-2,4-ditert. pentylphenoxy acetic acid | 2 | 0 | " | " | Pos. |
| 7 | " | 1 | 3 | Epoxy (Epikote 1004, Shell Chem. Corp.) | " | Pos. |
| 8 | " | 1 | 3 | Polystyrene (Piccolastic D 125, Pennsylvania Ind. Chem. Corp.) | " | Pos. |
| 9 | " | 0.75 | 2.5 | As in Nos. 1–6 | " | Pos. |
| 10 | " | 1 | 3 | Saturated polyester (Rutapal 8052, Bakelite G.m.b.H.) | " | Pos. |
| 11 | Safranine T-2,4-ditert. pentylphenoxy acetic acid | 1 | 3 | As in Nos. 1–6 | " | Pos. |
| 12 | Crystal Violet with phenoxy acetic acid | 1 | 3 | " | " | Pos. |
| 13 | Nile Blue-2,4-ditert. pentylphenoxy acetic acid | 1 | 3 | " | " | Pos. |
| 14 | Crystal Violet-2-(2,4-ditert.pentylphenoxy) butyric acid | 1 | 3 | " | " | Pos. |
| 15 | Crystal Violet-phenylglycine | 1 | 2.5 | Epoxy (Epikote 1004, Epikote 1007 1:1) | " | Pos. |
| 16 | Safranine T-2,4-ditert. pentylphenoxy acetic acid | 1 | 2.5 | " | " | Pos. |
| 17 | Neutral Red-2,4-ditert. pentylphenoxy acetic acid | 1 | 3 | As in Nos. 1–6 | " | Pos. |
| 18 | Pyronine G-2,4-ditert. pentylphenoxy acetic acid | 1.5 | 3 | " | " | Pos. |
| 19 | Janus Blue-2,4-ditert. pentylphenoxy acetic acid | 1 | 2.5 | " | " | Pos. |
| 20 | Victoria Blue BNS-2,4-ditert. pentylphenoxy acetic acid | 1 | 2.5 | " | " | Pos. |
| 21 | Nile Blue-DL-2-amino-caprylic acid | 0.5 | 3 | " | " | Pos. |
| 22 | Crystal Violet-dioctylsul-fosuccinic acid | 4 | 1 | Polyamide (Versamid 930, Schering A.G.) phenol resin modified with colophony (Arochem 455, Scado-Archer-Daniels G.m.b.H.), 2:1 | Iron | Pos. |
| 23 | Crystal Violet-isopropyl-naphthalene sulfonic acid | 4 | 1 | As in No. 22 | " | Pos. |
| 24 | Crystal Violet-2,4-ditert. pentylphenoxy acetic acid | 1 | 3 | As in Nos. 1–6 | Glass Beads | Pos. |
| 25 | Crystal Violet-phenylglycine | 1 | 3 | " | " | Pos. |
| 26 | Crystal Violet-2,4-ditert. pentylphenoxy acetic acid | 1 | 3 | Epoxy (Epikote 1004) | " | Pos. |
| 27 | Safranine T-2,4-ditert. pentylphenoxy acetic acid | 1 | 2.5 | Epoxy (Epikote 1004, Epikote 1007 1:1) | " | Pos. |
| 28 | Nile Blue -2,4-ditert. pentylphenoxy acetic acid | 1 | 3 | As in Nos. 1–6 | " | Pos. |
| 29 | Crystal Violet-dioctyl-sulfosuccinic acid | 0.125 | 2 | " | " | Pos. |

I claim:

1. Toner powder for the development of electrostatic images, comprising colored, thermoplastic resin particles, characterized in that said resin particles contain in dissolved condition therein a normal salt of an organic basic dye and an organic acid having at least 6 carbon atoms and having a dissociation constant lower than 4 as measured in water at 25 C., the dye of said salt being selected from the group consisting of di- and triphenylmethane dyes, azine dyes, acridine dyes, oxazine dyes, thiazine dyes, xanthene dyes and mono-azodyes.

2. Toner powder according to claim 1, the dye of said salt being a Safranine dye.

3. Toner powder according to claim 1, the organic acid of said salt being a monocarboxylic or monosulfonic acid.

4. Toner powder according to claim 1, the organic acid of said salt being a monoalkyl- or mono(alkylaryl) -ester of sulfuric acid.

5. Toner powder according to claim 1, the organic acid of said salt being of the general formula:

$$\text{I}\quad ROOC-\underset{\underset{SO_3H}{|}}{CH}-CH_2-COOR_1 \quad \text{or} \quad \text{II}\quad X-\underset{\underset{R_2}{|}}{CH}-COOH$$

in which R and $R_1$ each represents an alkyl group having at least 4 carbon atoms, $R_2$ is a hydrogen atom or an alkyl group, and X stands for an alkoxy or cycloalkoxy group having at least 4 carbon atoms, an aryloxy group, or a group

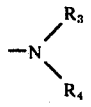

in which $R_3$ is a hydrogen atom or an alkyl or aryl group and $R_4$ is a hydrogen atom or an alkyl group.

6. Toner powder according to claim 5, said acid being one having said general formula II wherein X is a group:

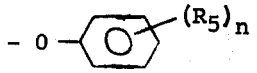

in which $R_5$ is an alkyl or alkoxy group and n is 1 or 2.

7. Toner powder according to claim 1, the basic dye of said salt being a Safranine dye and the organic acid of said salt having the formula:

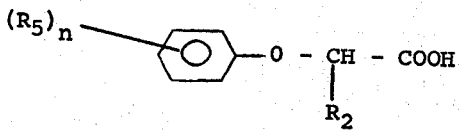

in which $R_2$ is a hydrogen atom or an alkyl group, $R_5$ is an alkyl or alkoxy group and *n* is 1 or 2.

* * * * *